US008709987B2

(12) United States Patent
Duchesne et al.

(10) Patent No.: US 8,709,987 B2
(45) Date of Patent: Apr. 29, 2014

(54) LUBRICATING OIL WITH ENHANCED PROTECTION AGAINST WEAR AND CORROSION

(75) Inventors: Perla Duchesne, Gravenchon (FR); John McDonald, Emeryville, CA (US); Sinquin Gilles, Manoir (FR); Pierre Tequi, Breaute (FR)

(73) Assignees: Chevron Oronite S.A., Cedex (FR); Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 13/397,081

(22) Filed: Feb. 15, 2012

(65) Prior Publication Data

US 2012/0142564 A1 Jun. 7, 2012

Related U.S. Application Data

(63) Continuation of application No. 11/755,387, filed on May 30, 2007, now abandoned.

(51) Int. Cl.
*C10M 169/04* (2006.01)
*C10M 125/10* (2006.01)

(52) U.S. Cl.
USPC ..... 508/186; 508/391; 508/460; 508/574

(58) Field of Classification Search
USPC ..... 508/186, 391, 460, 574
See application file for complete search history.

(56) References Cited

U.S. PATENT DOCUMENTS

| | | | | |
|---|---|---|---|---|
| 3,480,548 | A | 11/1969 | Hellmuth et al. | |
| 3,679,584 | A | 7/1972 | Hellmuth | |
| 3,853,772 | A | 12/1974 | Adams | |
| 3,929,650 | A | 12/1975 | King et al. | |
| 4,683,126 | A | 7/1987 | Inoue et al. | |
| 4,744,920 | A | 5/1988 | Fischer et al. | |
| 4,965,003 | A * | 10/1990 | Schlicht | 508/186 |
| 4,965,004 | A | 10/1990 | Schlicht et al. | |
| 5,098,587 | A * | 3/1992 | Hoornaert et al. | 508/186 |
| 5,346,636 | A | 9/1994 | Parc et al. | |
| 5,854,182 | A * | 12/1998 | Swami et al. | 508/186 |
| 6,008,165 | A | 12/1999 | Shanklin et al. | |
| 6,605,572 | B2 | 8/2003 | Carrick et al. | |
| 6,696,393 | B1 * | 2/2004 | Boffa | 508/287 |
| 6,777,378 | B2 * | 8/2004 | Abraham et al. | 508/185 |
| 6,790,813 | B2 | 9/2004 | Boffa | |
| 7,479,568 | B2 | 1/2009 | Le Coent et al. | |
| 2002/0058593 | A1 | 5/2002 | Bovington et al. | |
| 2003/0195128 | A1 * | 10/2003 | Deckman et al. | 508/591 |
| 2004/0077506 | A1 | 4/2004 | Arrowsmith et al. | |
| 2004/0224858 | A1 | 11/2004 | Esche | |
| 2005/0202981 | A1 * | 9/2005 | Eveland et al. | 508/295 |
| 2006/0025313 | A1 * | 2/2006 | Boffa | 508/199 |
| 2007/0203031 | A1 * | 8/2007 | Bardasz et al. | 508/192 |

FOREIGN PATENT DOCUMENTS

| | | |
|---|---|---|
| EP | 1475430 | 11/2004 |
| EP | 1792968 | 6/2007 |

OTHER PUBLICATIONS

International Lubricant Standardization and Approval Committee GF-4 Standard for passenger car engine oils (Jan. 14, 2004).*
International Search Report issued in counterpart European Patent Application No. 08251064.5-2104, (Oct. 2, 2008).
International Search Report issued in counterpart Singapore Patent Application No. 200803546-1.

* cited by examiner

*Primary Examiner* — Pamela H Weiss

(57) ABSTRACT

Provided is a lubricating oil composition comprising: (a) a major amount of an oil of lubricating viscosity; and (b) one or more borated alkaline earth metal alkyltoluene sulfonate detergents; wherein the lubricating oil composition comprises no more than about 0.20 wt. % of phosphorus and no more than about 0.50 wt. % of sulfur.

13 Claims, No Drawings

LUBRICATING OIL WITH ENHANCED PROTECTION AGAINST WEAR AND CORROSION

PRIORITY

This application is a continuation of co-pending U.S. patent application Ser. No. 11/755,387, filed May 30, 2007, the contents of which are incorporated herein by reference.

The present invention relates to lubricating oil compositions. More specifically, the present invention relates to lubricating oil compositions that have reduced levels of phosphorus and sulfur, yet provide improved lubricant performance as diesel engine oils, especially in heavy duty applications.

Environmental concerns have led to continued efforts to reduce the emissions of carbon monoxide (CO), hydrocarbon and nitrogen oxide ($NO_x$) from compression-ignited (diesel-fueled) and spark-ignited (gasoline-fueled) internal combustion engines. There have also been continued efforts to reduce the particulate emissions from compression-ignited internal combustion diesel engines. To meet the contemporary emission standards for passenger cars, other vehicles, and heavy-duty machineries, original equipment manufacturers (OEMs) have been applying exhaust gas after-treatment devices. Such exhaust gas after-treatment devices include, but are not limited to, catalytic converters and/or particulate traps.

Catalytic converters typically contain one or more oxidation catalysts, $NO_x$ storage catalysts, and/or $NH_3$ reduction catalysts. The catalysts contained therein generally comprise a combination of catalytic metals such as platinum, and metal oxides. Catalytic converters are installed in the exhaust systems, for example, the exhaust pipes of automobiles, to convert the toxic gases to nontoxic gases. The use of catalytic converters is thought to be essential in combating global warming trends and other environmental detriments. The catalysts, however, can be poisoned and rendered less effective, if not useless, as a result of exposure to certain elements or compounds, especially phosphorus compounds. Among the many ways phosphorus compounds may be introduced into the exhaust gas is the degradation of phosphorus-containing lubricating oil additives. Examples of phosphorus lubricating oil additives include zinc dialkyldithiophosphates and the like. Zinc dialkyldithiophosphates are among the most effective and conventionally used antioxidants and antiwear agents, from both a performance and cost-effectiveness standpoint, in lubricating oil compositions. While they are effective antioxidants and antiwear agents, the phosphorus, sulfur and ash they introduce into the engine react with the catalysts and may shorten the service life of the catalytic converters. Reduction catalysts are susceptible to damage by high levels of sulfur and sulfur compounds in the exhaust gas, which are introduced by the degradations of both the base oil used to blend the lubricants and sulfur-containing lubricant oil additives. Examples of sulfur-containing lubricant oil additives include, but are not limited to, magnesium sulfonate and other sulfated or sulfonated detergents.

Particulate traps are usually installed in the exhaust system, especially in diesel engines, to prevent the carbon black particles or very fine condensate particles or agglomerates thereof (i.e., "diesel soot") from being released into the environment. Aside from polluting air, water, and other elements of the environment, diesel soot is a recognized carcinogen. These traps, however, can be blocked by metallic ash, which is the degradation product of metal-containing lubricating oil additives including common ash-producing detergent additives.

To insure a long service life for the after-treatment devices, it is desirable to identify lubricating oil additives that exert a minimum negative impact on such devices. To this end, OEMs often set various limits for maximum sulfur and/or phosphorus for "new service fill" and "first fill" lubricants. For instance, when used in light-duty passenger-car internal combustion engines, the sulfur levels are typically required to be at or below 0.30 wt. %, and the phosphorus levels at or below 0.08 wt. %. The maximum sulfur, phosphorus and/or sulfated ash levels may differ, however, when the lubricating compositions are used in heavy-duty internal combustion engines. For example, the maximum phosphorus level may be as high as 0.2 wt. % in those heavy-duty engines, and the maximum sulfur level may be as high as 0.5 wt. %.

Efforts to enhance emission compatibility should not overshadow the need to provide adequate lubricant performance. Automobile spark ignition and diesel engines have valve train systems, including valves, cams and rocker arms, all of which must be lubricated and protected from wear. Further, engine oils must provide sufficient detergency so as to insure engine cleanliness and suppress the production of deposits, which are products of non-combustibles and incomplete combustibles of hydrocarbon fuels and deterioration of engine oils.

As discussed above, the need to preserve the integrity of catalytic converters has led to the use of less phosphate and phosphorus-containing additives. However, the use of detergents, which are typically metal sulfonate detergents, is often inevitable because of the sustained needs to neutralize the oxidation-derived acids and suspend polar oxidation residues in the lubricant. These detergents, however, contributes to the production of sulfur or sulfur compounds in the exhaust. Indeed, the amount of ash permitted under most of the current environmental standards can be exceeded by far less metal sulfonate detergent than is necessary to achieve adequate detergency performance. Reducing the levels of detergent overbasing may reduce the level of ash produced, but it also reduces the acid neutralizing capacity of the lubricant composition, potentially leading to acid corrosion of the engine pistons and other parts.

Therefore it would be advantageous to identify engine oil additives that not only foster cleaner environment by allowing the catalytic converters and particulate traps to effectively reduce pollutants, but also improve engine performance by, for instance, reduce wear and friction within that an engine. A need is thus apparent for compromises or new approaches through which both the environmental protection standards and the engine lubrication needs can be met.

A desirable lubricant for low phosphorus and low sulfur applications must also demonstrate minimum level of antiwear and anticorrosion benefits. But it has been observed that when the level of phosphorus is reduced in a lubricating oil composition, there tend to be an attendant reduction in antiwear, anticorrosion, or even antioxidation performance. To compensate for this loss in antiwear and/or anticorrosion capacity, certain boron-containing compounds have been found to provide wear and corrosion protection, as well as extreme-pressure benefits.

Various borated compounds have been prepared and employed as detergents by persons skilled in the art. For example, Parc et al. disclosed in U.S. Pat. No. 5,346,636, a colloidal material that contained boron and phosphorus. The colloidal product was obtained by a process comprising: (1) obtaining an alkali metal sulfonate or borated alkaline earth-sulfonate; (2) reacting the borated and overbased sulfonate of (1) with at least one phosphorous sulfide; and (3) separating the products obtained from the reaction. That colloidal product was said to confer favorable antiwear and extreme-pressure properties to lubricating oil compositions.

In another example, Shanklin et al. disclosed in U.S. Pat. No. 6,008,165, a lubricating oil composition that contained a borated dispersant, a metal salt of a phosphoric acid, a metal overbased composition comprising at least one carboxylate, phenate or sulfonate, wherein the metal was lithium, sodium, potassium, magnesium or calcium. The borated dispersant in that patent was an alcohol borate ester, which was said to confer favorable antiwear properties to lubricating oil compositions.

Moreover, Hellmuth et al. disclosed in U.S. Pat. No. 3,480,548, a lubricating oil composition prepared by reacting a lubricating oil dispersion of an alkaline earth metal carbonate and alkaline earth metal hydrocarbon sulfonate with a boron compound selected from: boric acids, boron oxides, and aqueous alkyl esters of boric acids. That additive was reported to function not only as an effective detergent but substantially improve oxidation stability and anticorrosive properties, especially against corrosions induced by ferrous metals.

Furthermore, King et al. disclosed in U.S. Pat. No. 3,929,650, a particulate dispersion of an alkali metal borate compound prepared by contacting boric acid with an alkali metal carbonate overbased metal sulfonate within an oleophilic liquid reaction medium. That particulate dispersion of metal borate compound was said to confer favorable extreme-pressure properties to lubricating oil compositions.

In yet another example, Carrick et al. disclosed in U.S. Pat. No. 6,605,572, a lubricating oil composition that contained a boron-containing compound:

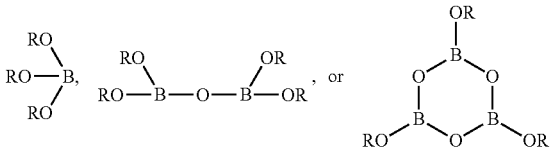

wherein each R was independently an organic group and any two adjacent R groups might together form a cyclic group; wherein the ratio of sulfur to boron to phosphorus was represented by the formula $S^1+5B^1+3P^1>0.35$, wherein $S^1$ was the concentration in percent by weight of sulfur in the composition, $B^1$ was the concentration in percent by weight of boron in the composition, and $P^1$ was the concentration in percent by weight of phosphorus in the composition. That lubricating oil composition contained 0.01 to 0.25 wt. % of sulfur, and 0.08 wt. % or less of phosphorus, and was said to impart improved wear protection.

The present invention provides lubricating oil compositions that provide high levels of protection against wear and anticorrosion benefits, but which introduce low levels of phosphorus and/or sulfur to diesel engines. The levels of phosphorus in the lubricating oil compositions of the present invention are typically at or below about 0.20 wt. %, or at or below about 0.16 wt. %, or even at or below about 0.12 wt. %. The levels of sulfur in the lubricating oil compositions of the present invention are typically at or below about 0.50 wt. %, or even at or below about 0.40 wt. %, such as at or below about 0.35 wt. %. Although not required, the amount of ash of these compositions are also typically low, calculated to be at or below about 1.6 wt. %, or at or below about 1.5 wt. %, or even at or below about 1.2 wt. %, such as at or below about 1.15 wt. %. Therefore, the present lubricating oil compositions are more desirable from an environmental standpoint than the conventional diesel engine oils that contain high phosphorus and sulfur. The compositions of the present invention facilitate longer service lives for the catalytic converters and the particulate traps while providing the desired protection against wear and corrosion in those engines.

In the first and broadest aspect, the present invention provides a lubricating oil composition suitable for use with various diesel engines, including the heavy duty ones, comprising a major amount of an oil of lubricating viscosity and one or more borated alkaline earth metal alkyltoluene sulfonate detergents, wherein the lubricating oil composition comprises no more than about 0.20 wt. % of phosphorus, and no more than about 0.50 wt. % of sulfur. The one or more borated alkaline earth metal alkyltoluene sulfonate detergents of this aspect are typically overbased. These detergents may be prepared by various known processes but may also be prepared by the improved process described herein.

In a second aspect, the present invention provides an additive package composition or a concentrate comprising one or more borated alkaline earth metal alkyltoluene sulfonate detergents in an organic diluent liquid, for example, base oil, and optionally also contain various other additives desired in lubricating oil, such as, for example, ashless dispersants, other non-borated metal-containing detergents, antiwear additives, antioxidants, friction modifiers, corrosion inhibitors, foam inhibitors, seal fixes or seal pacifiers.

In a third aspect, the invention provides a method of operating a diesel engine provided with one or more exhaust gas after-treatment devices, which method comprises lubricating said engine with a lubricating oil composition of the first aspect, or with an additive package composition or a concentrate of the second aspect.

In a fourth aspect, the invention provides a method of preparing a lubricating oil composition of the first aspect or an additive package/concentrate of the second aspect.

Persons skilled in the art will understand other and further objects, advantages, and features of the present invention by referring to the following description.

DETAILED DESCRIPTION OF THE INVENTION

Various features and embodiments are described below by way of non-limiting illustrations.

The present invention provides lubricating oil compositions as described above. The compositions have a total phosphorus content of at or below about 0.2 wt. % in typical embodiments, at or below about 0.16 wt. % in some other embodiments, and at or below about 0.12 wt. % in further embodiments. An exemplary lubricating oil composition of the present invention contains about 0.12 wt. % of phosphorus, based on the total weight of the composition.

The lubricating oil compositions of the present invention have a total sulfur content of at or below about 0.5 wt. % in typical embodiments, at or below about 0.4 wt. % in some other embodiments, and at or below about 0.35 wt. % in further embodiments. An exemplary lubricating oil composition of the present invention comprises about 0.34 wt. % of sulfur, based on the total weight of the composition.

Oil of Lubricating Viscosity

The lubricating oil composition of the present invention is comprised of one or more base oils, which are present in a major amount (i.e., an amount greater than about 50 wt. %). Generally, the base oil is present in an amount greater than about 60 wt. %, or greater than about 70 wt. %, or greater than about 80 wt. % of the lubricating oil composition. The base oil sulfur content is typically less than about 1.0 wt. %, preferably less than about 0.6 wt. %, more preferably less than about 0.4 wt. %, and particularly preferably less than about 0.3 wt. %. An exemplary lubricating oil composition of the present invention comprises about 87.2 wt. % of base oil.

Suitable base oils may be one that has a viscosity of at least about 2.5 cSt, or at least about 3.0 cSt, or even at least about 3.5 cSt, such as at least about 4.0 cSt. at 40° C. Suitable base oils may also be one that has a pour point of below about 20° C., or below about 10° C., or even below about 5° C., such as below about 0° C.

The base oil used in the lubricant compositions of the invention may be a natural oil, a synthetic oil, or a mixture thereof, provided that the sulfur content of such an oil does not exceed the above-indicated sulfur concentration limit required to sustain the low sulfur lubricating oil compositions. The natural oils that are suitable include animal oils and vegetable oils (e.g., castor oil, lard oil). The natural oils may also include mineral lubricating oils such as liquid petroleum oils and solvent-treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and the derivatives, analogs and homologs thereof, and the like. Synthetic lubricating oils also include oils prepared by a known Fischer-Tropsch gas-to-liquid synthetic procedure.

Another class of known synthetic lubricating oils includes alkylene oxide polymers and interpolymers and derivatives thereof where the terminal hydroxyl groups have been modified by a process such as esterification or etherification. Examples of these synthetic oils include polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1,000 or diphenyl ether of poly-ethylene glycol having a molecular weight of 1,000 to 1,500); and mono- and polycarboxylic esters thereof (e.g., acetic acid esters, mixed $C_3$-$C_8$ fatty acid esters, and $C_{13}$ Oxo acid diester of tetraethylene glycol).

Yet another suitable class of synthetic lubricating oils are the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol esters such as neopentyl glycol, trimethylolpropane, pentaerythritol, dipentacrythritol and tripentaerythritol.

The synthetic oil can also be a poly-alpha-olefin (PAO). Typically, the PAOs are derived from monomers having from 4 to 30, or from 4 to 20, or from 6 to 16 carbon atoms. Examples of useful PAOs include those derived from octene, decene, mixtures thereof, and the like. These PAOs may have a viscosity from 2 to 15, or from 3 to 12, or from 4 to 8 $mm^2/s$ (cSt) at 100° C. Mixtures of mineral oil with one or more of the foregoing PAOs may be used.

Unrefined, refined and rerefined oils, either natural or synthetic (as well as mixtures of two or more) of the types of oils disclosed above can be used in the lubricating compositions of the present invention. Unrefined (or raw) oils are those obtained directly from a natural or synthetic source without further purification treatment. Refined oils are similar-to the unrefined oils except they have been further treated in one or more purification steps. Many such purification techniques are known to those skilled in the art such as solvent extraction, secondary distillation, acid or base extraction, filtration, percolation, and the like. Rerefined oils are oils that have been used in service but are subsequently treated so that they may be re-applied in service. Because the used oils almost always contain spent additives and breakdown products, in addition to the standard oil refining steps, steps that would remove the spent additives and breakdown products must be taken. Such rerefined oils are also known as reclaimed or reprocessed oils.

Borated Alkaline Earth Metal Alkyltoluene Sulfonate Detergents

It has been found that the incorporation of certain borated alkaline earth metal alkyltoluene sulfonate detergents of the present invention provides lubricating oil compositions with the desired levels of wear and corrosion protection. The new approach allows for top tier engine performance with lower than conventional levels of phosphorus and sulfur. The borated alkaline earth metal alkyltoluene sulfonate detergents of the present invention can be prepared by various known procedures as well as by the new and improved process described herein.

Certain methods of making borated sulfonates are known in the art. For example, in U.S. Pat. No. 4,683,126, Inoue et al. disclosed a two-step method for producing an alkaline earth metal borate dispersion. During the first step, materials (A) to (E) are mixed and undergo a reaction at 20° C. to 100° C., where (A) is 100 parts by weight of an oil soluble neutral sulfonate of an alkaline earth metal; (B) is 10 to 100 parts by weight of a hydroxide or an oxide of an alkaline earth metal; (C) is boric acid in an amount that is 0.5 to 6.5 times of that of (B); (D) is 5 to 50 parts by weight of water; and (E) is 50 to 200 parts by weight of a dilution solvent. During the second step, the reaction mixture of the first step was heated to 100° to 200° C. in order to remove the water and much of the dilution solvent. The disclosure of this patent, to the extent it pertains to the preparation of borated sulfonates, and to the extent it does not conflict with the disclosures and claims herein, is incorporated by reference.

In two related patents, Hellmuth et al. disclosed a method of preparing a borated additive and a method of overbasing and increasing the total base number (TBN) of such a borated additive. Specifically, they described in U.S. Pat. No. 3,480,548, a borated additive prepared by reacting a lubricating oil dispersion of an alkaline earth metal carbonate and an alkaline earth metal hydrocarbon sulfonate with a boron compound selected from the group consisting of boric acids, boron oxides, and aqueous alkyl esters of boric acids. Moreover, in U.S. Pat. No. 3,679,584, they described a process for increasing the proportion of alkaline earth metal in an overbased alkaline earth metal sulfonate lubricating oil composition. That process comprised: (1) mixing a carbonate-overbased alkaline earth metal sulfonate, an alkaline earth metal hydroxide, and boric acid; and (2) contacting the resultant mixture with carbon dioxide. The disclosures of these patents, to the extent they pertain to the preparation of borated sulfonates, and to the extent they do not conflict with the disclosures and claims herein, are incorporated by reference.

In yet another example, Fischer et al. disclosed in U.S. Pat. No. 4,744,920, a carbonate-overbased product that was also borated. Specifically, that process comprised: (a) mixing an overbased sulfonate with one or more inert liquid media; (b) borating the mixture of (a) with a borating agent at a temperature that was sufficiently low to prevent substantial foaming; (c) raising the temperature of the mixture of (b) to a temperature that was higher than the boiling point of water; (d) remove substantially all of the water that was added to or generated from the reaction from the rest of the reaction mixture of (c), while retaining substantially all of the carbonate; and (e) harvesting the product of (d). The disclosure of this patent, to the extent it pertains to the preparation of borated sulfonates, and to the extent it does not conflict with the disclosures and claims herein, is incorporated by reference.

In a further example, Schlicht disclosed in U.S. Pat. No. 4,965,003, a process for preparing a borated and overbased oil soluble metal detergent additive for lubricants. Specifically, that process comprised: (a) mixing a metal salt dissolved in a hydrocarbon solvent with a metal base and a polar solvent; (b) treating the metal salt mixture of (a) at a temperature ranging from about 10° C. to about 100° C. while passing an acidic gas through the mixture; (c) filtering the treated mixture of (b) at a temperature of about 10° C. to about 100° C.; (d) adding a borating agent to the filtrate of (c) and reacting the filtrate with the borating agent for a period of about 0.25 to about 5.0 hours at a temperature ranging from about 15° C. to about 100° C.; (e) heating the borated mixture of (d) at a temperature sufficiently high to distill all the water and a major portion of the polar solvent; (f) cooling the distilled and borated mixture of (e) to below the boiling point of the remaining solvent and filtering the cooled filtrate mixture; and (g) stripping the cooled and distilled filtrate mixture of (f) under a pressure ranging from about 10 to about 200 mms Hg, and at a temperature ranging from about 20° C. to about 150° C., thereby recovering the borated metal detergent additive. The disclosure of this patent, to the extent it pertains to the preparation of borated sulfonates, and to the extent it does not conflict with the disclosures and claims herein, is incorporated by reference.

A variation of this process was disclosed by Schlicht et al. in U.S. Pat. No. 4,965,004. That process comprised: (a) adding a borating agent to an overbased metal salt in the presence of a protic solvent and a hydrocarbon solvent and reacting for a period of 0.25 to 5.0 hours at a temperature ranging from 15° C. to 100° C.; (b) heating the borated metal salt mixture of (a) to a sufficiently high temperature so that at least about 80 percent of the protic solvent feed could be distilled; (c) cooling the distilled borated mixture of (b) to below the boiling point of the remaining solvent and filtering the cooled filtrate mixture; and (d) stripping the cooled distilled filtrate mixture of (c) under a pressure ranging from 10 to 200 mms Hg and at a temperature ranging from 20° C. to 150° C., and recovering the borated metal detergent additive. Again, the disclosure of this patent, to the extent it pertains to the preparation of borated sulfonates, and to the extent it does not conflict with the disclosures and claims herein, is incorporated by reference.

An Improved Process to Prepare Borated Alkaline Earth Metal Alkyltoluene Sulfonate Specifically, the borated alkaline earth metal alkyltoluene sulfonate detergents of the present invention can be prepared using an improved process comprising:

(a) reacting (i) at least one oil soluble alkyltoluene sulfonic acid, or an oil soluble alkaline earth alkyltoluene sulfonate salt, or a mixture thereof;

(ii) at least one source of an alkaline earth metal'

(iii) at least one source of boron, in the presence of a mixture comprising:

(a) at least one hydrocarbon solvent;

(b) at least one low molecular weight alcohol;

and (iv) one or more overbasing acids, at least one of which is boric acid;

(b) heating the reaction product from step (a) to a temperature that is greater than the distillation temperatures of the hydrocarbon solvent, the low molecular weight alcohol, and any water generated from step (a), so that the solvent, alcohol and water generated may be distilled from the product of step (a); wherein no external source of water is added to the reaction mixture during the process.

A borated alkaline earth metal toluene sulfonate salt prepared by this process typically has low sediment rate. For example, the volume of sediment may be less than about 0.15 vol. %, or less than about 0.12 vol. %, or less than about 0.10 vol. %, or even less than about 0.05 wt. %, such as less than about 0.03 vol. %, based on the total volume the resulting salt. The sediment rate can be measured by certain standard methods that are well known in the art, such as the ASTM D2273.

A number of known hydrocarbon solvents can be used in this process. For example, a suitable hydrocarbon solvent may be n-pentane, n-hexane, cyclohexane, n-heptane, n-octane, isooctane, n-decane, or mixtures thereof. A suitable hydrocarbon solvent may also be an aromatic solvent, such as one selected from: xylene, benzene, toluene, and mixtures thereof.

A suitable alcohol for this process is typically one of relatively low molecular weight, having, for example, about 1 to about 13 carbon atoms and/or a molecular weight of no greater than about 200. Alcohols of those molecular weights tend to have boiling points that are sufficiently low so that they may be distilled from the reaction mixture after the reactions are complete. For example, a suitable alcohol may be one selected from a variety of low-molecular-weight monohydric alcohols, each comprising about 1 to about 13 carbon atoms. More specifically, such an alcohol may be, for example, methanol, ethanol, propanol, isooctanol, cyclohexanol, cyclopentanol, isobutyl alcohol, benzyl alcohol, beta-phenyl-ethyl alcohol, 2-ethylhexanol, dodecanol, tridecanol, 2-methylcyclohexanol, sec-pentyl alcohol, and tert-butyl alcohol. An exemplary borated alkaline earth metal alkyltoluene sulfonate salt of the present invention is prepared in the presence of methanol.

A suitable low molecular weight alcohol may also be a polyhydric alcohol. For example, such an alcohol may be a dihydric alcohol, such as ethylene glycol.

Moreover, derivatives of certain suitable low molecular weight monohydric or polyhydric alcohols may also be used. Examples of these derivatives may include glycol monoethers and monoesters, such as monomethyl ether of ethylene glycol and monobutyl ether of ethylene glycol.

The alkyltoluene sulfonic acids from which the borated alkaline earth metal alkyltoluene sulfonate salts of the present invention may derive can be prepared by methods that are known in the art. For example, the alkyltoluene sulfonic acids may be prepared by sulfonating alkyltoluene precursors using known sulfonating agents, such as, for example, sulfuric acid, sulfur trioxide, chlorosulfonic acid, or sulfamic acid. Other conventional methods, such as the $SO_3$/Air Thin Film Sulfonation method may also be applied, wherein the alkyltoluene precursors are mixed with a $SO_3$/Air falling film made by, for example, CHEMITHON® or BALLESTRA®.

In turn, the alkyltoluene precursor may be originally derived from a conventional Friedel-Crafts reaction that alkylates toluene with an olefin. A suitable alkyltoluene precursor may comprise an alkyl chain that is about 10 to about 40, or about 14 to about 30, or even about 18 to about 26, carbon atoms long. The toluene ring may be linked to any position on the alkyl chain except for position 1 on the alkyl chain. As persons skilled in the art will appreciate, "position 1" on an alkyl chain refers to the carbon position at the end of the chain. On the other hand, the alkyl chain can be linked to the toluene ring at any carbon position, except for the position at which the methyl group of the toluene is attached.

The olefin that is used to alkylate the toluene can be a single olefin or a mixture of various olefins, although the latter is typically the alkylation agent of choice. Regardless whether a single olefin or a mixture is used to alkylate the toluene, however, the olefins are often isomerized. If the olefins are isomerized, they may be isomerized prior to, during, or after the alkylation step, but are preferably isomerized prior to the alkylation step.

Methods of isomerizing olefin are known. Persons skilled in the art typically use one of at least two types of acidic catalysts for this purpose. Specifically, the acidic catalysts can be solid or liquid. A number of known solid acidic catalysts may be suitable, but a solid catalyst having at least one metal oxide is preferred. The metal oxide can be one selected from: natural zeolites, synthetic zeolites, synthetic molecular sieves, and clays. For example, the solid acidic catalyst comprises the acid forms of an acidic clay, or an acidic molecular sieve, or a zeolite having an average pore size of at least 6.0 angstroms. Useful acidic clays, including, for example, montmorillonite, laponite and saponite, may be derived from naturally-occurring or synthetic materials. Pillared clays may also serve as alkylation catalysts. Other molecular sieves with one-dimensional pore systems, having average pore sizes of less than 5.5 angstroms, may also serve as acidic catalysts. Examples include SM-3, MAPO-11, SAPO-11, SSZ-32, ZSM-23, MAPO-39, SAPO-39, ZSM-22, SSZ-20, ZSM-35, SUZ-4, NU-23, NU-86, and natural or synthetic ferrierites. These catalysts are described, for example, in HANDBOOK OF MOLECULAR SIEVES by Rosamarie Szostak (New York, Van Norsrand Reinhold, 1992), and in U.S. Pat. No. 5,282,858, which are hereby incorporated by reference.

The isomerization process can be carried out, for example, at temperatures ranging from about 50° C. to about 280° C. Because olefins tend to have high boiling points, the process is suitably carried out in the liquid phase, in batch or continuous mode. In the batch mode, a stirred autoclave or glass flask, which may be heated to the desired reaction temperature, is typically used. On the other hand, a continuous process is most efficiently carried out in a fixed-bed process. In a fixed-bed process, space rates, which measure the rates of contact between the reactants and the catalyst beds, can range from about 0.1 WHSV to about 10 or more WHSV (i.e., weight of reactant feed per weight of catalyst per hour). The catalyst is charged into the reactor, which can be heated to the desired reaction temperature. The olefin can also be heated before it is exposed to the catalyst bed.

Persons skilled in the art are able to choose isomerization conditions under which particular levels of isomerization may be achieved. Specifically, the level of isomerization is typically characterized by the amount of alpha olefins and the level of branching in a particular olefin sample or mixture. The amount of alpha olefin and the level of branching can in turn be determined using various conventional methods, including, for example, Fourrier Transformed Infra Red (FTIR) spectroscopy by following the absorbance of a sample at 910 $cm^{-1}$. The percentage of branching can also be measured by FTIR spectroscopy by following the absorbance of a sample at 1378 $cm^{-1}$.

While the olefins in the alkylation mixture may be branched or linear, an exemplary process of the present invention involves an alkyltoluene that is derived from a mixture of primarily linear alpha olefins.

The alkylation step of the present invention may take place prior to, simultaneously with, or after, the isomerization step. It is however preferred that the isomerization step occurs before the alkylation step, so that the olefins that are used to alkylate toluene comprise isomerized olefins.

Various known alkylation methods can be used to make the alkyltoluene precursors. For example, a typical alkylation reaction, which takes place in the presence of a hydrogen fluoride catalyst, may competently serve this purpose. Regardless of the method used to achieve alkylation, however, a one-stage reactor is nearly always used as the preferred vessel in which the reaction would take place.

The alkylation process typically takes place at a temperature ranging from about 20° C. to about 250° C. Similar to the isomerization process discussed above, the alkylation process is preferably carried out in a liquid phase to accommodate the liquid olefins at these temperatures. The alkylation process may be activated in batch or continuous mode, with the former mode being carried out in a heated and stirred autoclave or glass flask, and with the latter mode carried out in a fixed-bed process. In either mode, the reactor effluent typically contains alkyltoluene, mixed with excess toluene. The excess toluene can be removed by distillation, stripping evaporation under vacuum, or other means known to those skilled in the art.

A second and alternative starting material in the novel process described above may be an alkaline earth metal alkyltoluene sulfonate salt, which can also be prepared by methods known to those skilled in the art. Specifically, it may be obtained by reacting an alkyltoluene sulfonic acid with a source of suitable alkaline earth metal in the presence of a hydroxilic promoter. Conventionally this hydroxilic promoter may be water, but the reaction may also be carried out in the absence of any external water source of water. In that case, the only water that may or may not be present in the reaction mixture is the byproduct of the reaction. Instead of water, a suitable alcohol such as 2-ethyl hexanol, methanol, or ethylene glycol may serve as the hydroxilic promoter.

Moreover, this reaction takes place in an inert solvent, in which the resulting sulfonate salt may be dissolved. As stated above, that inert solvent may be selected from: n-pentane, n-hexane, cyclohexane, n-heptane, n-octane, isooctane, n-decane, benzene, toluene, xylene, and mixtures thereof.

Suitably, the alkaline earth metal may be calcium, barium, magnesium, or strontium. For example, the alkaline earth metal alkyltoluene sulfonate may be a calcium salt, and the corresponding reactive base of that salt may be calcium hydroxide (also known as lime) or calcium oxide.

The weight ratio of low molecular weight alcohol to the source of an alkaline earth metal in the process is typically greater than about 0.20:1, or greater than about 0.30:1, or even greater than about 0.35:1, such as about 0.40:1.

The alkaline earth metal alkyltoluene sulfonate salt of the present invention, whether derived originally from an oil soluble alkyltoluene sulfonic acid starting material or is itself the starting material, is further borated. Specifically, a source of boron is introduced into the reaction mixture to achieve this end. That source may be in the form of, for example, boric acid, boron anhydride, boron esters, or similar boron-containing materials. The boron source of an exemplary process of the present invention is orthoboric acid (also known as boric acid). Although no external source of water is added to the reaction mixture, water is nonetheless the byproduct of the reaction involving an alkaline earth metal reactive base with an alkyltoluene sulfonic acid and/or an alkaline earth alkyltoluene sulfonate salt, in the presence of a suitable low molecular weight alcohol. It is believed that condensation of boric acid may occur in the presence of water to form boric acid oligomers, such as, for example, those represented by the formulae below:

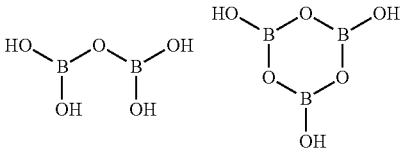

These oligomers then react with the alkaline earth metal reactive bases to form borated salts, thereby introducing boron into the alkaline earth metal alkyltoluene sulfonates of the present invention.

The borated alkaline earth metal alkyltoluene sulfonate salts of the present invention are typically overbased. By definition, overbased materials are characterized by a metal content in excess of that which would be present according to the stoichiometry of the metal cation in the sulfonate said to be overbased. The term "base number" or "BN" refers to the amount of base equivalent to milligrams of KOH in one gram of sample. Thus, higher BN reflects more alkaline products and thus a greater alkalinity reserve. The BN of samples can be determined by a variety of methods, including, for example, ASTM test No. D2896 and other equivalent procedures. The term "total base number" or "TBN" refers to the amount of base equivalent to milligrams of KOH in one gram of functional fluid. These terms are often used interchangeably with "base number" or "BN," respectively. The term "low overbased" refers to a BN or TBN of about 2 to about 60. The term "high overbased" refers to a BN or TBN of about 60 or more.

The borated alkaline earth metal alkyltoluene sulfonate salts of the present invention may have a TBN of about 10 to about 500, or about 50 to about 400, or even about 100 to about 300, such as about 150 to about 200. An exemplary borated alkaline earth metal alkyltoluene sulfonate salt of the present invention is highly overbased and has a TBN of about 160.

Many conventional methods and reaction conditions for overgbasing involve overbasing by carbon dioxide. Examples of such methods and conditions are described in U.S. Pat. No. 3,496,105, and others. The borated alkaline earth metal alkyltoluene sulfonates of the present invention are overbased, each with one or more overbasing acids, at least one of which is boric acid. Accordingly, if boric acid is included in the process as the source of boron, it may also serve to overbase the resulting borated salt.

The borated alkaline earth metal alkyltoluene sulfonate salt of the present invention may be prepared by, for example, first premixing a hydrocarbon solvent such as xylene with a low molecular weight alcohol such as methanol and a source of an alkaline earth metal such as a calcium hydroxide. This premixing step may be performed at or near ambient temperature, such as at about 15° C. to about 40° C., or at about 20° C. to about 35° C.

Following premixing and if necessary, foam inhibitors and other processing aids may optionally be added to the reaction vessel.

An alkyltoluene sulfonic acid may then be added to the mixture with agitation. Typically, the alkyltoluene sulfonic acid is added slowly over a period of time to avoid a rapid rise in temperature in the reaction mixture, maintaining the temperature of that mixture in a range of about 20° C. to about 55° C. Thereafter, the reaction mixture is agitated for about 5 minutes to about 20 minutes at a temperature of about 40° C. to about 50° C., or about 41° C. to about 46° C., so as to insure adequate neutralization of the alkaline earth metal reactive base. The reaction mixture is then cooled using a bath or other cooling mechanism to about 20° C. to about 25° C., or about 21° C. to about 24° C., and is held at this temperature range for about 1 hour to about 3 hours. This neutralization step may be omitted if an alkaline earth metal alkyltoluene sulfonate salt is the starting material instead of an alkyltoluene sulfonic acid.

A source of boron such as boric acid is then added slowly over a period of about 20 minutes to about 40 minutes to the neutralized reaction mixture, while maintaining the temperature of that mixture at about 20° C. to about 30° C. This is followed by holding the reaction mixture at about 25 to about 50° C. for an additional 15 minutes. Again, this mixture is cooled to about 20° C. to about 25° C. The cooling mechanism is then removed from the reaction vessel either immediately or within about 30 minutes.

Typically, the reaction mixture is then slowly heated to reach one or more intermediate temperatures. It is believed that this stepped heating approach may serve to reduce the sediment rate in the final product. For example, a borated alkaline earth metal alkyltoluene sulfonate salt of the present invention may be prepared in a process comprising heating the reaction mixture to a first intermediate temperature of about 65° C. in about 20 minutes to about 40 minutes, followed by heating to a second intermediate temperature of about 80° C. in about 90 minutes to about 2 hours, followed by heating to a third intermediate temperature of about 90° C. to about 95° C. in about 1 hour.

The low molecular weight alcohol, the hydrocarbon solvent, as well as the water that has been generated during the reaction so far are then removed from the reaction mixture through separation methods that are known in the art. For example, the borated alkaline earth metal alkyltoluene sulfonate salts of the present invention may be prepared in a process comprising the well-known method of distillation, simply heating the reaction mixture to above the boiling temperatures of the alcohol, solvent and water. In that process, the reaction mixture is heated to reach a temperature of about 125° C. to about 140° C. in about 1 hour.

Optionally, an inert liquid medium, such as a diluent oil or a lubricant base oil, may then be added to the reaction mixture to reduce the viscosity of the reaction mixture and/or disperse the product. Suitable diluent oils are known in the art, and are defined, for example, in Fuels and Lubricants Handbook, (George E. Totten, ed., (2003)) at page 199, as "base fluids . . . of mineral origin, synthetic chemical origin or biological origin." It may not be necessary to add such an inert liquid medium at this juncture if, for example, the product is extruded.

The distillation step typically continues for about 2 hours at a temperature of about 180° C. to about 200° C., followed by holding the reaction mixture for about 15 minutes at that temperature. The unreacted alkaline earth metal reactive base, source of boron (if other than boric acid), and boric acid are then eliminated using conventional and well known methods such as centrifugation and/or filtration. For example, the borated alkaline earth metal alkyltoluene sulfonate salt of the present invention may be prepared in a process comprising the filtering of the reaction product in the presence of a certain filter aid in a precoated pressure filter, followed by washing the resulting pellet with precoat oil and storing such a pellet.

The resulting borated alkaline earth metal alkyltoluene sulfonate salt of the present invention comprises about 2 to about 6 wt. %, or about 3 to about 5 wt. %, or even about 3.2 to about 4.5 wt. %, such as about 3.5 to about 4.3 wt. %, of boron. The level of boron in the salt can be measured by certain standard methods that are well known in the art, such as, for example, the ASTM D4951, or ASTM D5185. Moreover, the resulting borated alkaline earth metal alkyltoluene sulfonate of the present invention typically has a boron to alkaline earth metal ion ratio of in the range of about 1:0.2 to about 1:0.7, or about 1:0.3 to about 1:0.6, or even about 1:0.5 to about 1:0.58, such as about 1:0.51 to about 1:0.56.

Moreover, a borated alkaline earth metal alkyltoluene sulfonate salt prepared of the present invention has a viscosity at 100° C. of about 150 cSt to about 280 cSt, or about 170 cSt to about 250 cSt, such as about 200 cSt, as measured in accordance with the ASTM D445. That salt may also have a flash point of greater than about 170° C., or even about 180° C., such as about 190° C., as measured in accordance with the ASTM D93.

The lubricating oil composition of the present invention comprised one or more borated alkaline metal alkyltoluene sulfonate salts prepared in accordance with a variety of suitable processes such as those exemplified above. Typically, a lubricating oil composition of the present invention may comprise about 5 to about 60 mM, or about 10 to about 50 mM, or even about 15 to about 40 mM, of one or more borated alkaline earth metal alkyltoluene sulfonate salts, based on the total weight of the lubricating oil composition. An exemplary lubricating oil composition of the present invention comprises about 16 mM of a borated calcium alkyltoluene sulfonate salt, based on the total weight of that lubricating oil composition.

Other Additives

Metal-Containing Detergents

The lubricating oil compositions of the present invention may comprise one or more other metal-containing but non-borated detergents in addition to the one or more borated alkaline earth metal alkyltoluene sulfonate salts described above. Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The composition of the present invention may contain one or more non-borated detergents, which are normally salts, and especially overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid, such as carbon dioxide) with a mixture comprising an acidic organic compound, in a reaction medium comprising at least one inert, organic solvent (such as mineral oil, naphtha, toluene, or xylene) in the presence of a stoichiometric excess of a metal base and a promoter.

The acidic organic compounds useful in making the overbased compositions of the present invention include carboxylic acids, sulfonic acids, phosphorus-containing acids, phenols or mixtures thereof. Frequently, the acidic organic compounds are carboxylic acids or sulfonic acids with sulfonic or thiosulfonic groups (such as hydrocarbyl-substituted benzenesulfonic acids), and hydrocarbyl-substituted salicylic acids.

Carboxylate detergents, e.g., salicylates, can be prepared by reacting an aromatic carboxylic acid with an appropriate metal compound such as an oxide or hydroxide. Neutral or overbased products may then be obtained by methods well known in the art. The aromatic moiety of the aromatic carboxylic acid can contain heteroatoms, such as nitrogen and oxygen, but preferably, the moiety contains only carbon atoms. Suitably, the moiety contains six or more carbon atoms, such as a benzene moiety. The aromatic carboxylic acid may contain one or more aromatic moieties, such as one or more benzene rings, fused or otherwise connected via alkylene bridges. Examples of aromatic carboxylic acids include salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides. In that case, salicylic acids are generally obtained in a diluent in admixture with uncarboxylated phenol.

Sulfonates can be prepared by using sulfonic acid in to sulfoniate alkyl-substituted aromatic hydrocarbons such as those obtained from the fractionation of petroleum or those obtained from alkylation of aromatic hydrocarbons. Alkaryl sulfonates usually contain from about 9 to about 80 or more carbon atoms, preferably from about 16 to about 60 carbon atoms per alkyl-substituted aromatic moiety.

Metal salts of phenols and sulfurized phenols are prepared by reaction with an appropriate metal compound such as an oxide or hydroxide. Neutral or overbased products may be obtained by methods well known in the art. For example, sulfurized phenols may be prepared by reacting a phenol with sulfur or a sulfur-containing compound such as hydrogen sulfide, sulfur monohalide or sulfur dihalide, to form products that are mixtures of compounds in which 2 or more phenols are bridged by sulfur-containing bridges.

The metal compounds useful in making the overbased salts are generally any Group 1 or Group 2 metal compounds in the Periodic Table of the Elements. The Group 1 metals of the metal compound include Group 1a alkali metals (e.g., sodium, potassium, lithium) as well as Group 1b metals such as copper. The Group 1 metals are preferably sodium, potassium, lithium and copper, more preferably sodium or potassium, and particularly preferably sodium. The Group 2 metals of the metal base include the Group 2a alkaline earth metals (e.g., magnesium, calcium, strontium, barium) as well as the Group 2b metals such as zinc or cadmium. Preferably the Group 2 metals are magnesium, calcium, barium, or zinc, more preferably magnesium or calcium, particularly preferably calcium.

Examples of the overbased detergents include, but are not limited to calcium sulfonates, calcium phenates, calcium salicylates, calcium salixarates and mixtures thereof. Overbased detergents suitable for use with the lubricating oils of the present invention may be low overbased (i.e., Total Base Number (TBN) below 100). The TBN of such a low-overbased detergent may be from about 5 to about 50, or from about 10 to about 30, or from about 15 to about 20. The overbased detergents suitable for use with the lubricating oils of the present invention may alternatively be high overbased (i.e., TBN above about 100). The TBN of such a high-overbased detergent may be from about 150 to about 450, or from about 200 to about 350, or from about 250 to about 280. A low-overbased calcium sulfonate detergent with a TBN of about 16, and a high-overbased calcium sulfurized phenate with a TBN of about 260 are two exemplary overbased detergents in the lubricating oil compositions of the present invention. The lubricating oil compositions of the present invention may comprise more than one overbased detergents, which may be all low-TBN detergents, all high-TBN detergents, or a mix of the those two types.

Suitable detergents for the lubricating oil compositions of the present invention also include "hybrid" detergents such as, for example, phenate/salicylates, sulfonate/phenates, sulfonate/salicylates, sulfonates/phenates/salicylates, and the like. Hybrid detergents have been described, for example, in U.S. Pat. Nos. 6,153,565, 6,281,179, 6,429,178, and 6,429,179. The disclosures of these patent applications and patents, to the extend they pertain to hybrid detergents and do not conflict with the disclosures herein, are incorporated by reference in the entirety.

For the lubricant oil compositions of the present invention, the amount of the non-borated overbased detergent(s), if present, may be from about 0.5 to about 50 mM, or from about 1 to about 40 mM, or even from about 2 to about 38 mM. In an exemplary embodiment of the present invention, about 4 mM of a low-TBN sulfonate detergent plus about 32 mM of a high-TBN sulfurized phenate detergent are present in the lubricating oil composition.

Ashless Dispersants

The lubricating oil compositions of the present invention may also comprise one or more ashless dispersants. Dispersants are generally used to maintain in suspension insoluble materials resulting from oxidation during use, thus preventing sludge flocculation and precipitation or deposition on metal parts. Nitrogen-containing ashless (metal-free) dispersants are basic, and contribute to the TBN of a lubricating oil composition to which they are added, without introducing additional sulfated ash. An ashless dispersant generally comprises an oil soluble polymeric hydrocarbon backbone having functional groups that are capable of associating with particles to be dispersed. Many types of ashless dispersants are known in the art.

Typical dispersants include, but are not limited to, amines, alcohols, amides, or ester polar moieties attached to the polymer backbones via bridging groups. The ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

"Carboxylic dispersants" are reaction products of carboxylic acylating agents (acids, anhydrides, esters, etc.) comprising at least 34 and preferably at least 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersants. They are produced by reacting hydrocarbyl-substituted succinic acylating agent with organic hydroxy compounds, or with amines comprising at least one hydrogen attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures, which may be represented by the formula:

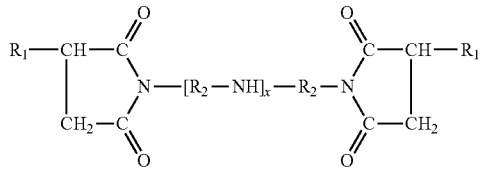

wherein each $R_1$ is independently a hydrocarbyl group, such as a polyolefin-derived group. Typically the hydrocarbyl group is an alkyl group, such as a polyisobutyl group. Alternatively expressed, the $R_1$ groups can contain about 40 to 500 carbon atoms, and these atoms may be present in aliphatic forms. $R_2$ is an alkylene group, commonly an ethylene ($C_2H_4$) group. Succinimide dispersants have been more fully described in, for example, U.S. Pat. Nos. 4,234,435, 3,172,892 and 6,165,235. The disclosures of these patents, to the extend they pertain to succinimide dispersants and do not conflict with the disclosures herein, are incorporated by reference in the entirety.

The polyalkenes from which the substituent groups are derived are typically homopolymers and interpolymers of polymerizable olefin monomers of 2 to 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contains nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a normally liquid and substantially inert organic liquid solvent/diluent. The reaction temperature is generally in the range of about 80° C. up to the decomposition temperature of the mixture or the product, which typically falls between 100° C. and 300° C. Additional details and examples of the procedures for preparing the succinimide dispersants of the present invention have been described in, for example, U.S. Pat. Nos. 3,172,892, 3,219,666, 3,272,746, 4,234,435, 6,440,905 and 6,165,235. The disclosures of these patents, to the extend they pertain to preparation of succinimide dispersants and do not conflict with the disclosures herein, are incorporated by reference in the entirety.

Suitable ashless dispersants may also include amine dispersants, which are reaction products of relatively high molecular weight aliphatic halides and amines, preferably polyalkylene polyamines. Examples thereof have been described, for example, in U.S. Pat. Nos. 3,275,554, 3,438,757, 3,454,555, 3,565,804, and the like. The disclosures of these patents, to the extend they pertain to amine dispersants and do not conflict with the disclosures herein, are also incorporated by reference in the entirety.

Suitable ashless dispersants may further include "Mannich dispersants," which are reaction products of alkyl phenols in which the alkyl group contains at least 30 carbon atoms with aldehydes (especially formaldehyde) and amines (especially polyalkylene polyamines). These dispersants have been described, for example, in U.S. Pat. Nos. 3,036,003, 3,586,629, 3,591,598, 3,980,569, and the like. The disclosures of these patents, to the extend they pertain to Mannich dispersants and do not conflict with the disclosures herein, are likewise incorporated orated by reference.

Suitable ashless dispersants may even include post-treated dispersants, which are obtained by reacting carboxylic, amine or Mannich dispersants with reagents such as dimercaptothiazoles, urea, thiourea, carbon disulfide, aldehydes, ketones, carboxylic acids, hydrocarbon-substituted succinic anhydrides, nitrile epoxides, boron compounds and the like. Post-treated dispersants have been described, for example, in U.S. Pat. Nos. 3,329,658, 3,449,250, 3,666,730, and the like. The disclosures of these patents, to the extend they pertain to post-treated dispersants and do not conflict with the disclosures herein, are further incorporated by reference.

Suitable ashless dispersants may be polymeric, which are interpolymers of oil-solubilizing monomers such as decyl methacrylate, vinyl decyl ether and high molecular weight olefins with monomers containing polar substitutes. Polymeric dispersants have been described, for example, in U.S. Pat. Nos. 3,329,658, 3,449,250, 3,666,730, and the like. The disclosures of these patents are similarly incorporated by reference.

In an exemplary lubricating oil composition of the present invention, a bissuccinimide treated with ethylene carbonate is used as the ashless dispersant. In another exemplary lubricating oil composition of the present invention, a borated bissuccinimide derived from heavy polyamine and a polyisobutylene succinic anhydride is used as the ashless dispersant. In yet another exemplary lubricating oil composition of the present invention, an ashless dispersant mixture comprising both of these bissuccinimides is used.

The ashless dispersant is suitably present in an amount of from about 0.5 to about 10.0 wt. %, or about 2.0 to about 8.0 wt. %, or even about 3.0 to about 7.0 wt. %, such as about 4.0 to about 6.0 wt. %. An exemplary lubricating oil composition of the present invention comprises an ethylene-carbonate treated bissuccinimide dispersant in an amount of about 2.0 wt. %. Another lubricating oil composition of the present invention comprises a borated bissuccinimide dispersant in an amount of about 4.0 wt. %, as well as an ethylene-carbonate treated bissuccinimide dispersant in an amount of about 2.0 wt. %.

Antiwear Agents

The lubricating oil compositions of the present invention may further comprise one or more antiwear agents. Dihydrocarbyl dithiophosphate metal salts are frequently used as antiwear and antioxidant agents. The metal may be an alkali or alkaline earth metal, or aluminum, lead, tin, molybdenum, manganese, nickel or copper. The amount of this particular type of antiwear agent may be limited by the phosphosphorus content maximum of the lubricating oil compositions of the present invention. Accordingly, these zinc salts may be present in the lubricating oil in amounts of about 12 to about 24 mM, or about 14 to about 22 mM, or even about 16 to about 20 mM. An exemplary lubricating oil composition of the present invention comprises about 19 mM of a zinc dithiophosphate.

They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most often employed. Commercial additives frequently contain an excess of zinc due to the use of an excess of the basic zinc compound in the neutralization reaction.

The preferred oil soluble zinc dialkyldithiophosphates may be produced from dialkykyldithiophosphoric acids of the formula:

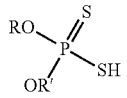

The hydroxyl alkyl compounds from which the dialkyldithiophosphoric acids are derived can be represented generically by the formula ROH or R'OH, wherein R or R' is alkyl or substituted alkyl, preferably branched or non-branched alkyl containing 3 to 30 carbon atoms. More preferably, R or R' is a branched or non-branched alkyl containing 3 to 8 carbon atoms.

Mixtures of hydroxyl alkyl compounds may also be used. These hydroxyl alkyl compounds need not be monohydroxy alkyl compounds. The dialkyldithiophosphoric acids may thus be prepared from mono-, di-, tri-, tetra-, and other polyhydroxy alkyl compounds, or mixtures of two or more of the foregoing. Preferably, the zinc dialkyldithiophosphate derived from only primary alkyl alcohols is derived from a single primary alcohol. Preferably, that single primary alcohol is 2-ethylhexanol. Preferably, the zinc dialkyldithiophosphate derived from only secondary alkyl alcohols. Preferably, that mixture of secondary alcohols is a mixture of 2-butanol and 4-methyl-2-pentanol.

The phosphorus pentasulfide reactant used in the dialkyldithiophosphoric acid formation step may contain minor amounts of any one or more of $P_2S_3$, $P_4S_3$, $P_4S_7$, or $P_4S_9$. Compositions as such may also contain minor amounts of free sulfur.

Viscosity Index Modifiers

The lubricating oil compositions of the present invention may optionally comprise one or more viscosity index modifiers. The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to 250,000, preferably from about 15,000 to 200,000, more preferably from about 20,000 to 150,000. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

The exemplary lubricating oil compositions of the present invention employ various ethylene-propylene copolymers, which may or may not be grafted by maleic anhydride. The copolymers may be employed at an amount from about 0.2 to about 10.0 wt. %, or about 1.0 to about 8.0 wt. %, such as about 2.0 to about 6.0 wt. %, of the lubricating oil composition.

Friction Modifiers

In certain embodiments, the lubricating oil compositions of the present invention further comprises one or more friction modifiers. Various sulfur-containing organo-molybdenum compounds are known to function as friction modifiers in lubricating oil compositions, while also providing antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof.

Oil soluble or dispersible trinuclear molybdenum compounds can be prepared by reacting in the appropriate liquid (s)/solvent(s) a molybdenum source such as $(NH_4)_2Mo_3S_{13}n(H_2O)$, where n varies between 0 and 2 and includes non-stoichiometric values, with a suitable ligand source such as a tetralkylthiuram disulfide. Other oil soluble or dispersible trinuclear molybdenum compounds can be formed during a reaction in the appropriate solvent(s) of a molybdenum source, such as of $(NH_4)_2Mo_3S_{13}.n(H_2O)$, a ligand source such as tetralkylthiuram disulfide, dialkyldithiocarbamate, or dialkyldithiophosphate, and a sulfur-abstracting agent such as cyanide ions, sulfite ions, or substituted phosphines. Alternatively, a trinuclear molybdenum-sulfur halide salt such as $[M']_2[MO_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil soluble or dispersible trinuclear molybdenum compound. The appropriate liquid/solvent may be, for example, aqueous or organic.

The terms "oil soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

An exemplary lubricating oil composition of the present invention employs a molybdenum succinimide complex as friction modifier. Of the lubricating oil composition, the molybdenum complex may constitute from about 0.1 to 0.8 wt. %, or from about 0.15 to about 0.5 wt. %, or even from about 0.20 to about 0.40 wt. %. An exemplary lubricating oil composition of the present invention comprises a sulfurized molybdenum succinimide complex in an amount of about 0.20 wt. %, based on the total weight of the lubricating oil composition.

Antioxidants

The lubricating oil compositions of the present invention may optionally further comprise one or more antioxidants. Oxidation inhibitors or antioxidants reduce the tendency of mineral oils to deteriorate in service. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in, for example, U.S. Pat. No. 4,867,890.

Aromatic amines having at least two aromatic groups attached directly to the nitrogen constitute another class of compounds that is frequently used for antioxidancy. Typical oil soluble aromatic amines having at least two aromatic groups attached directly to one amine nitrogen contain from 6 to 16 carbon atoms. The amines may contain more than two aromatic groups. The aromatic rings are often substituted by one or more substituents selected from, for example, alkyl, cycloalkyl, alkoxy, aryloxy, acyl, acylamino, hydroxy, and nitro groups.

Lubricating oil compositions in accordance with the present invention may contain from about 0.05 to about 5.0 wt. %, or from about 0.10 to about 3.0 wt. %, such as from about 0.50 to about 2.0 wt. %, of one or more antioxidants. An exemplary lubricating oil composition of the present invention comprises about 0.5 wt. % of an antioxidant that is di-$C_8$-diphenylamine. Another exemplary lubricating oil composition of the present invention comprises about 1.0 wt. % of a hindered phenolic propionate ester antioxidants as well as about 0.5 wt. % of di-$C_8$-diphenylamine.

Other Additives

Other additives may be incorporated into the lubricating oil compositions of the present invention to satisfy the particular performance requirements associated with diesel engine oils. Examples of such other additives include, for example, rust inhibitors, anti-foaming agents, and seal fixes.

Rust inhibitor or anticorrosion agents may be a nonionic polyoxyethylene surface active agent. Nonionic polyoxyethylene surface active agents include, but are not limited to, polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Rust inhibitors or anticorrosion agents may also be other compounds, which include, for example, stearic acid and other fatty acids, dicarboxylic acids, metal soaps, fatty acid amine salts, metal salts of heavy sulfonic acid, partial carboxylic acid ester of polyhyric alcohols, and phosphoric esters.

Foam inhibitors typically include alkyl methacrylate polymers and dimethyl silicon polymers. Exemplary compositions of the present invention contain silicon-based foam inhibitors in amounts ranging from about 10 ppm to about 50 ppm, or from about 20 ppm to about 40 ppm, such as about 30 ppm, based on the total weight of the composition.

Seal fixes are also termed seal swelling agents or seal pacifiers. They are often employed in lubricant or additive compositions to insure proper elastomer sealing, and prevent premature seal failures and leakages. Seal swell agents may be, for example, oil soluble, saturated, aliphatic, or aromatic hydrocarbon esters such as di-2-ethylhexylphthalate, mineral oils with alkphatic alcohols such as tridecyl alcohol, triphosphite ester in combination with a hydrocarbonyl-substituted phenol, and di-2-ethylhexylsebacate.

Some of the above-mentioned additives can provide a multiplicity of effects; thus for example, a single additive may act as a dispersant as well as an oxidation inhibitor. These multifunctional additives are well known.

As readily understood by those skilled in the art, the amounts of certain additives are suitably listed with the unit "mM" rather than the unit "wt. %." An amount of an additive, when listed with the unit "mM," is calculated with reference to the amount of calcium ion in 1 kilogram of an additive concentrate comprising such an additive.

When lubricating compositions contain one or more of the above-mentioned additives, each additive is typically blended into the base oil in an amount that enables the additive to provide its desired function. It may be desirable, although not essential, to prepare one or more additive concentrates comprising additives (concentrates sometimes being referred to as additive packages) whereby several additives can be added simultaneously to the oil to form the lubricating oil composition. The final composition may employ from 5 to 30 wt. %, preferably 5 to 25 wt. %, typically 10 to 20 wt. % of the concentrate, the remainder being the oil of lubricating viscosity. An exemplary final lubricating oil composition of the present invention employs about 12.8 wt. % of a concentrate, with the remainder being a suitable oil of lubricating viscosity. The components can be blended in any order and can be blended as combinations of components.

This invention will be further understood by reference to the following examples, which are not to be considered as limitative of its scope.

EXAMPLES

The following examples are provided to illustrate the present invention without limiting it. While the present invention has been described with reference to specific embodiments, this application is intended to encompass those various changes and substitutions that may be made by those skilled in the art without departing from the spirit and scope of the appended claims.

Example 1

Preparing an Overbased Borated Calcium Alkyltoluene Sulfonate Salt

In a 5-liter glass vessel, about 228 grams of methanol, about 1800 grams of xylene, and about 192.5 grams of hydrated lime (calcium hydroxide) were mixed to achieve homogeneity or near homogeneity. About 572 grams of an alkyltoluene sulfonic acid, which had a molecular weight of about 471, was added to the vessel, while maintaining the temperature in the reaction mixture in the range of about 20° C. to about 30° C. This addition was completed in about 15 minutes. About 291.9 grams of boric acid powder was then added to the vessel, while maintaining the temperature of the reaction mixture in the range of about 30° C. to about 35° C. The reaction mixture was then kept at this temperature for about 15 minutes. The vessel containing the reaction mixture was then heated in 3 steps: (1) from about 35° C. to about 65° C.; (2) from about 65° C. to about 93° C.; and from about 93° C. to about 128° C. About 358 grams of a Group 1 mineral oil was added to the vessel and the mixture was stirred. The entire mixture was then subject to centrifugation at a 10,000 G and the solid sediment was removed. This was followed by heating the liquid phase to about 185° C. under a vacuum of about 40 mbar, thereby distilling the solvent xylene.

This process was repeated in a second batch using the set of steps and the same amount of all materials except that the amount of methanol added to the premixture was increased to about 240 grams. The resulting salts were analyzed and its various properties are listed in Table 1 below.

TABLE 1

Analysis of the borated calcium alkyltoluene sulfonate salts

| Properties | Batch 1 | Batch 2 |
|---|---|---|
| wt. % Calcium | 7.66 | 7.90 |
| wt. % Sulfur | 2.81 | 2.80 |
| wt. % Boron | 4.09 | 4.08 |
| Base Number (mgKOH/g) | 168 | 174 |
| Closed Cup PMCC Flash Point (° C.) | 202 | 196 |

Example 2

Larger Scale Preparation of an Overbased Borated Calcium Alkyltoluene Sulfonate A 1900-liter stainless steel reactor equipped with a turbine mixer, a hot-oil jacket and a cooling coil was used as the reaction vessel. About 798 kilograms of mixed xylene was charged into the vessel. The reactor was then cooled to about 20° C., which was below the flash point of xylene. A nitrogen purge step was used to reduce the amount of oxygen in the reactor to about 3 ppm. About 126 kilograms of calcium hydroxide powder was then added to the reactor via a screw conveyer. The contents in the reactor was blended and mixed, while about 351 kilograms of alkyltoluene sulfonic acid was added to the reactor over a period of about 48 minutes, during which the temperature of the reaction mixture rose to about 43° C. The reactor was cooled to about 20° C., and about 195 kilograms of boric acid was added through the screw conveyor over a period of about 10 minutes. About 113 kilograms of methanol was then added to the reactor over a period of about 15 minutes, during which the temperature of the reaction mixture rose to about 36° C. The contents of the reactor was blended and mixed at that temperature for about another 15 minutes. The reactor was then heated in 4 steps at atmospheric pressure to remove the methanol and the water that was generated during the reaction: (1) from about 34° C. to about 69° C., over a period of about 60 minutes; (2) from about 69° C. to about 78° C., over a period of about 100 minutes; (3) from about 78° C. to about 93° C., over a period of about 60 minutes; and (4) from about 93° C. to about 127° C., over a period of about 60 minutes. About 163 kilograms of a 100 Neutral Oil was added to the reactor. The reactor was then heated to about 171° C. and the pressure in the reactor was reduced to about 50 mms Hg over a period of about 115 minutes so that the xylene may be distilled. The pressure in the reactor was then restored to the atmospheric pressure. Thereafter, about 23 kilograms of 100 Neutral Oil was added to the reactor. A pressure filter with the aid of diatomaceous earth was used to filter away the sediments, which was estimated to be about 1.2 vol. %. The resulting borated alkyltoluene sulfonate salt was analyzed and its properties are listed below in Table 2.

TABLE 2

Larger scale preparation of an overbased borated calcium alkyltoluene sulfonate

| Properties | Large Scale Batch |
|---|---|
| wt. % Calcium | 7.65 |
| wt. % Sulfur | 2.78 |
| wt. % Boron | 4.03 |
| Base Number (mgKOH/g) | 167 |
| Kinematic Viscosity @ 100° C. (cSt) | 112 |

Example 3

Evaluation of Protection Against Wear

Oil A and Comparative Oil A were prepared and tested for wear protection in a modified 4-Ball wear test. Specifically, a typical 4-ball machine was used. Prior to the test, the steel balls were "pre-aged" in the test sample oil for 2 days at 160° C. in the presence of an air flow at 15 liter/hour, using a simple glass tube as a bubbler. The machine was run at a single speed, at approximately 1800 revolutions per minute. An auto-loading system comprising a motor, a loading arm, and a force transducer mounted between the motor and loading arm, was used to apply load to the balls. The force transducer was also connected to a computer that measured and adjusted the load in accordance to the amount of load required at each given stage of the test. At the far end of the loading arm, a displacement sensor was mounted, which measured the distance between the sensor and the loading arm once every minute and recorded the results, giving a continuous readout of the extent of wear. The equipment further comprised a torque sensor, which measured the friction of the rotating ball vis-à-vis the lower stationary balls, recording a readout every minute. A temperature sensor was also mounted to the ball holder to maintain temperature of the oils.

The components of Oil A and Comparative Oil A are listed below in Table 3, where the results of the modified 4-ball wear test are listed below in table 4. Oil A and Comparative Oil A each has a phosphorus content of about 0.12 wt. % and a sulfur content of about 0.34 wt. %.

TABLE 3

Components of Oil A and Comparative Oil A

| Components | Oil A | Comparative Oil A |
|---|---|---|
| Borated Calcium Alkyltoluene Sulfonate | 16 mM | None |
| Borated Succinimide | 4 wt. % | 4 wt. % |
| Ethylene Carbonate-Treated Bissuccinimide | 2 wt. % | 2 wt. % |
| Low Overbased Benzene Sulfonate | 4 mM | 4 mM |
| High Overbased Phenate | 32 mM | 32 mM |
| Zinc-DTP | 19 mM | 19 mM |
| Molybdenum Complex | 0.2 wt. % | 0.2 wt. % |
| di-C8-diphenylamine | 0.5 wt. % | 0.5 wt. % |
| Hindered Phenolic Ester | 1 wt. % | 1 wt. % |
| Foam Inhibitor | 30 ppm | 30 ppm |
| Pour Point Depressant | 0.2 wt. % | 0.2 wt. % |
| Viscosity Index Improver | 3.6 wt. % | 3.6 wt. % |
| MA-Grafted EP Copolymer | 6 wt. % | 6 wt. % |
| Treat Rate | 12.8 wt. % | 12.8 wt. % |

TABLE 4

Results of the Modified 4-Ball Wear Test

| | Oil A | Comparative Oil A |
|---|---|---|
| Ponderated Wear Index | 25 (average of 2 runs) | 34.6 (average of 3 runs) |

It may be observed that Oil A, which comprised about 16 mM of a borated calcium alkyltoluene sulfonate salt detergent, exhibited significantly improved protection against wear, as compared to Comparative Oil A, which does not comprise such a detergent.

Oil B and Comparative Oil B were prepared in accordance to the components listed below in Table 5. Specifically, Comparative Oil B comprised a borated calcium alkylbenzene sulfonate rather than a borated calcium alkyltoluene sulfonate salt. Oil B and Comparative Oil B each has a sulfur content of about 0.39 wt. % and a phosphorus content of about 0.16 wt. %.

The wear protection capacities of these oils were determined in a standard Mack T-12 test, which simulates the operating conditions of a heavy duty diesel engine and allows the measurement of wear in the presence of the test oils. Specifically, a modified Mack E7 E-Tech 460 engine rated at 460 bhp and 1800 rpm, with EGR and 2002 low-swirl combustion system, was used in the test. In a 300-hour procedure, the first 100 hours were rated speed and power to generate soot. Thereafter, in the last 200 hours, the engine was overfueled at peak torque rpm to maximize the wear on the rings and the liners. The amount of wear on the rings and liners are reported below in Table 6.

TABLE 5

Components of Oil B and Comparative Oil B

| Components | Oil B | Comparative Oil B |
|---|---|---|
| Borated Calcium Alkyltoluene Sulfonate | 15 mM | None |
| Borated Calcium Alkylbenzene Sulfonate | None | 15 mM |
| Borated Bissuccinimide | 0.85 wt. % | 0.85 wt. % |
| Ethylene Carbonate-Treated Bissuccinimide | 6.60 wt. % | 6.60 wt. % |
| Molybdenum Complex | 0.10 wt. % | 0.10 wt. % |
| Pour Point Depressant | 0.30 wt. % | 0.30 wt. % |
| High Overbased Phenate | 15 mM | 15 mM |
| Low Overbased Sulfonate | 1.75 mM | 1.75 mM |
| Di-C8-Diphenylamine | 0.05 wt. % | 0.05 wt. % |
| Secondary Zinc DTP | 22 mM | 22 mM |
| Primary Zinc DTP | 4 mM | 4 mM |
| Foam Inhibitor | 10 ppm | 10 ppm |
| Viscosity Index Improver | 8.3 wt. % | 8.3 wt. % |
| Treat Rate | 14.05 wt. % | 14.05 wt. % |

TABLE 6

Results of the Mack T-12 Test

| | Oil B | Comparative Oil B | Pass/Fail Standard CJ-4 |
|---|---|---|---|
| Linear Wear (μM) | 25.9 | 25 | ≤24 |
| Top Ring Weight Loss (mg) | 60 | 81 | ≤105 |
| EOP Pb Increase (ppm) | 15 | 18 | ≤35 |
| 250-300 hr. Pb Increase (ppm) | 8 | 8 | ≤15 |
| Oil Consumption (g/h) | 60.7 | 80.6 | ≤85 |
| Total Mack Merits | 905 | 641 | ≥1000 |

As can be observed from Table 6, the lubricating oil composition comprising a borated calcium alkyltoluene sulfonate salt performed better in linear wear, top ring weight loss, Pb increase, oil consumption and total Mack merits than a corresponding lubricating oil composition comprising a borated calcium alkylbenzene sulfonate salt. The latter salt has been demonstrated to impart improved wear protection to lubricating oil compositions to which that salt is a part.

Example 4

Evaluation of Protection Against Corrosion

Oil C and Comparative Oil C were prepared in accordance with the list of components in Table 7 below. Specifically, Comparative Oil C comprised a borated calcium alkylbenzene sulfonate salt rather than a borated calcium alkyltoluene sulfonate salt. Oil C and Comparative Oil C each has a phosphorus content of about 0.12 wt. % and a sulfur content of about 0.34 wt. %.

The corrosion protection capacities of these oils were determined and compared in a standard ASTM D6549 (HTCBT) test for their capacity to protect the engine against corrosion. Specifically, four metal coupons including copper, lead, tin and phosphor bronze were immersed in a measured amount of the test oils. Air was passed through the oils at an elevated temperature for a period of time. When the test was completed, the coupons and stressed oils were examined to detect corrosion. Concentrations of copper, lead and tin were reported in Table 8 below.

TABLE 7

Components of Oil C and Comparative Oil C

| Components | Oil C | Comparative Oil C |
|---|---|---|
| Borated Calcium Alkyltoluene Sulfonate | 16 mM | None |
| Borated Calcium Alkylbenzene Sulfonate | None | 16 mM |
| Borated Succinimide | 4 wt. % | 4 wt. % |
| Ethylene Carbonate-Treated Bissuccinimide | 2 wt. % | 2 wt. % |
| Low Overbased Sulfonate | 4 mM | 4 mM |
| High Overbased Phenate | 32 mM | 32 mM |
| Zinc-DTP | 19 mM | 19 mM |
| Molybdenum Complex | 0.2 wt. % | 0.2 wt. % |
| di-C8-diphenylamine | 0.5 wt. % | 0.5 wt. % |
| Hindered Phenolic Ester | 1 wt. % | 1 wt. % |
| Foam Inhibitor | 30 ppm | 30 ppm |
| Pour Point Depressant | 0.2 wt. % | 0.2 wt. % |
| Viscosity Index Improver | 3.6 wt. % | 3.6 wt. % |
| MA-Grafted EP Copolymer | 6 wt. % | 6 wt. % |
| Treat Rate | 12.8 wt. % | |

TABLE 8

Results of the HTCBT Test

| | Oil C | Comparative Oil C | Pass/Fail Standard |
|---|---|---|---|
| Cu (ppm) | 6 | 6 | ≤20 |
| Sn (ppm) | 1 | 1 | ≤50 |
| Pb (ppm) | 8 | 11 | ≤100 |

From Table 8, one may draw the conclusion that a lubricating oil composition comprising a borated calcium alkyltoluene sulfonate salt has marginally better anticorrosive capacity than a composition comprising a borated calcium alkylbenzene sulfonate salt.

What is claimed is:

1. A lubricating oil composition comprising: (a) a major amount of an oil of lubricating viscosity; (b) about 5 to about 60 mM of one or more overbased borated alkaline earth metal alkyltoluene sulfonate detergents; (c) a mixture of a low overbased calcium sulfonate detergent and a high overbased calcium phenate detergent, wherein the low overbased calcium sulfonate detergent has a TBN of less than 100 and the high overbased calcium phenate detergent has a TBN of greater than 100; and (d) one or more friction modifiers, wherein at least one of the friction modifiers is a molybdenum succinimide complex; wherein the lubricating oil composition comprises no more than about 0.20 wt. % of phosphorus and no more than about 0.50 wt. % of sulfur.

2. A lubricating oil composition comprising: (a) a major amount of an oil of lubricating viscosity; and (b) about 5 to about 60 mM of one or more overbased borated alkaline earth metal alkyltoluene sulfonate detergents prepared by a process comprising: (i) reacting (1) at least one oil soluble toluene sulfonic acid, or an oil soluble alkaline earth metal toluene sulfonate salt, or a mixture thereof; (2) at least one source of an alkaline earth metal; and (3) one or more overbasing acids, at least one of which is boric acid, in the presence of a mixture comprising: (4) at least one hydrocarbon solvent; and (5) at least one low molecular weight alcohol; (ii) heating the reaction product from step (i) to a temperature that is greater than the distillation temperatures of the hydrocarbon solvent, the low molecular weight alcohol, and any water generated from step (i), so that the solvent, alcohol and water generated may be distilled from the product of step (i); wherein no external source of water is added to the reaction mixture during the process; wherein the lubricating oil composition further comprises (c) a mixture of a low overbased calcium sulfonate detergent and a high overbased calcium phenate detergent, wherein the low overbased calcium sultanate detergent has a TBN of less than 100 and the high overbased calcium phenate detergent has a TBN of greater than 100; and (d) one or more friction modifiers, wherein at least one of the friction modifiers is a molybdenum succinimide complex and further wherein the lubricating oil composition comprises no more than about 0.20 wt. % of phosphorus and no more than about 0.50 wt. % of sulfur.

3. The lubricating oil composition of claim 1, wherein the one or more overbased borated alkaline earth metal alkyltoluene sulfonate detergents has a TBN of about 10 to about 500.

4. The lubricating oil composition of claim 1, further comprising one or more additives selected from the group consisting of ashless dispersants, antiwear agents, viscosity index modifiers, friction modifiers, antioxidants, rust inhibitors, foam inhibitors, and seal fixes.

5. The lubricating oil composition of claim 2, further comprising one or more additives selected from the group consisting of ashless dispersants, antiwear agents, viscosity index modifiers, friction modifiers, antioxidants, rust inhibitors, foam inhibitors, and seal fixes.

6. The lubricating oil composition of claim 5, wherein at east one of the one or more antiwear agents is zinc dithiophosphate.

7. The lubricating oil composition of claim 2, comprising at least about 50 ppm of boron, based on the total weight of the lubricating oil composition.

8. The lubricating oil composition of claim 2, wherein each of the one or more overbased borated alkaline earth metal alkyltoluene sulfonate detergents is derived from an alkyltoluene sulfonic acid, and wherein the alkyl group of the alkyltoluene sulfonic acid comprises about 10 to about 40 carbon atoms.

9. The lubricating oil composition of claim 8, wherein the alkyl group of the alkyltoluene sulfonic acid is a linear alkyl group.

10. A method of reducing wear in a diesel engine comprising operating said engine with the lubricating oil composition of claim 1.

11. A method of reducing corrosion in a diesel engine comprising operating said engine with the lubricating oil composition of claim 1.

12. A method of reducing wear in a diesel engine comprising operating said engine with the lubricating oil composition of claim 2.

13. A method of reducing corrosion in a diesel engine comprising operating said engine with the lubricating oil composition of claim 2.

* * * * *